United States Patent [19]

Lang

[11] 4,442,778

[45] Apr. 17, 1984

[54] MULTIPLE STORY TOWER

[76] Inventor: Franz J. Lang, Uhlandstrasse 5, D-6233 Kelkheim (Taunus), Fed. Rep. of Germany

[21] Appl. No.: 494,136

[22] Filed: May 16, 1983

Related U.S. Application Data

[63] Continuation of Ser. No. 234,571, Feb. 13, 1981, abandoned.

[30] Foreign Application Priority Data

Feb. 2, 1980 [DE] Fed. Rep. of Germany ..... 3006377

[51] Int. Cl.[3] ..... A47B 47/00

[52] U.S. Cl. ..... 108/111; 108/156; 211/186

[58] Field of Search ..... 108/111, 106, 91, 96, 108/156, 157, 159; 211/186, 188, 189, 194

[56] References Cited

U.S. PATENT DOCUMENTS

| | | | |
|---|---|---|---|
| 903,377 | 11/1908 | Hebestreit | 108/111 X |
| 3,695,190 | 10/1972 | Bucholz | 108/111 X |
| 3,834,324 | 9/1974 | Lang | 108/111 X |
| 3,847,458 | 11/1974 | Nowak | 108/111 X |
| 3,927,625 | 12/1975 | Lang | 108/111 X |
| 4,068,600 | 1/1978 | Driscoll | 108/111 |

FOREIGN PATENT DOCUMENTS

| | | |
|---|---|---|
| 2153603 | 10/1971 | Fed. Rep. of Germany . |
| 2261983 | 12/1972 | Fed. Rep. of Germany . |

*Primary Examiner*—William E. Lyddane
*Assistant Examiner*—Peter Brown
*Attorney, Agent, or Firm*—Toren, McGeady and Stanger

[57] ABSTRACT

In a multiple-story tower for the display of merchandise with a plurality of story decks and with between the story decks, spacing supports which can be stuck detachably with their ends into upper and lower receiving shafts at the story decks, it is suggested that with a substantially rectangular outline of the story decks, there be arranged at two opposite sides of the rectangle approximately in the middle thereof respectively one spacing support. It is preferred thereat that the spacing supports be constructed with a groove profile, whereat the concave groove side of spacing supports arranged at opposite rectangular sides of a story deck face one another.

7 Claims, 5 Drawing Figures

MULTIPLE STORY TOWER

This application is a continuation, of application Ser. No. 234,571, filed Feb. 13, 1981, now abandoned.

The invention relates to a multiple-story tower for the display of merchandise with a plurality of story decks and with, between the story decks, spacing supports which can be stuck detachably with their ends into upper and lower receiving shafts at the story deck.

Such a multiple-story tower is known from the West German Offenlegungsschriften Nos. 21 53 603 and 22 61 983.

In the known embodiments, there are arranged, in the case of rectangular outer contours of the story decks, spacing supports in the four corners of the story decks, in such a way that two consecutive story decks are connected with one another by respectively four spacing supports.

It is further known from the West German Offenlegungsschrift Nos. 22 61 983 to connect with one another two consecutive story decks with respectively only one spacing support which can be arranged centrally or asymmetrically in relation to the respective story decks.

At the bottom of this invention there is the task of setting forth a multiple-story tower which, with optimal accessibility to the merchandise spread out on the story decks and with optimal view onto the merchandise spread out there, possesses a high degree of stability.

For the solution of this task it is suggested according to the invention that with a substantially rectangular outline of the story decks, there be arranged at two opposite sides of the rectangle, approximately in the middle thereof, respectively one spacing support.

According to a preferred embodiment, the spacing supports are constructed with a groove profile, whereat the concave groove sides of spacing supports arranged at opposite rectangular sides of a story deck face one another. Thereat the spacing supports can have an approximately semicircular arc-shaped groove profile. The total extension of the spacing supports in the longitudinal direction of their respectively corresponding rectangle sides can be smaller than the length of these rectangle sides. The semicircular arc-shaped groove profile can extend over nearly 180°. In order to afford a secure but still detachable hold of the spacing supports in the receiving shafts, there can be provided between the ends of the spacing supports and the respective receiving shafts securing means.

In the case of the embodiment of a multiple-story tower with a groove profile, a receiving shaft can be defined by respectively an outer shaft-limiting wall which is part of a story-deck-encircling wall and by at least one inner shaft-limiting wall which faces the outer shaft-limiting wall at a distance corresponding to the wall thickness of the spacing supports. Thereat the inner shaft-limiting wall begins at the respective story deck and can be fabricated in one piece with the story deck.

With a view towards the securing and toward as stable as possible an anchoring of the spacing supports at the story decks there can be chosen the following construction:

At least one edge area of the spacing support projects in a horizontal direction beyond an inner shaft-limiting wall at the end of the spacing support; this projecting edge area can be lifted off from the outer shaft-limiting wall against elastic resistance, whereat the elastic resistance is dependent upon the inner structure of the material of the spacing support; between the outer shaft-limiting wall and the projecting edge area there are provided securing means which are detachable from the outer shaft-limiting wall by lifting off the projecting edge area.

An additional or alternative securing possibility results from the following construction:

Facing the outer shaft-limiting wall of a receiving shaft there are two inner shaft-limiting walls which are spaced from one another in the direction of the horizontal extension of the outer shaft-limiting wall; a middle part of a spacing support end located between these two inner shaft-limiting walls can be lifted off from the outer shaft-limiting wall; there are provided securing means at this middle part of the spacing support end and at the outer shaft-limiting wall.

Thereat, the middle part of the spacing support end can be constructed resiliently in relation to the rest of the spacing support by slots in the spacing support, whereat the resiliency property naturally again makes prerequisite the use of corresponding material for the spacing supports. The slot configuration can thereat be roughly such that two slots extend, on both sides of the middle part of the spacing support end, from one end of the spacing support in a direction parallel to the longitudinal direction of the spacing support.

The securing means—no matter at what point they are affixed—can be formed by functionally interrelated pins and depressions of the outer shaft-limiting wall and the spacing support.

The pins and depressions can thereat be constructed in such a way that they automatically rest in one another when a spacing support is stuck into a receiving shaft.

For the stability of the multiple-story tower according to the invention it is of substantial significance that securing means are provided not only in the crest area of each respective groove profile but also at the edge areas and that the end of each respective spacing support stands on the respective story deck when the securing means are in engagement.

The attached figures elucidate the invention with the example of an embodiment.

FIG. 1 represents the schematic diagram of a multiple-story tower according to the invention;

In FIG. 1, a multiple-story tower is designated overall with 10. This multiple-story tower consists of a plurality of story decks 12 and respectively two spacing supports 14 between two consecutive story decks 12.

The story decks 12 are, as can be seen from FIG. 1, each encircled by an encircling wall 16 extending preferably for the same distance upwards and downwards perpendicularly to the respective story deck.

Figure 2:
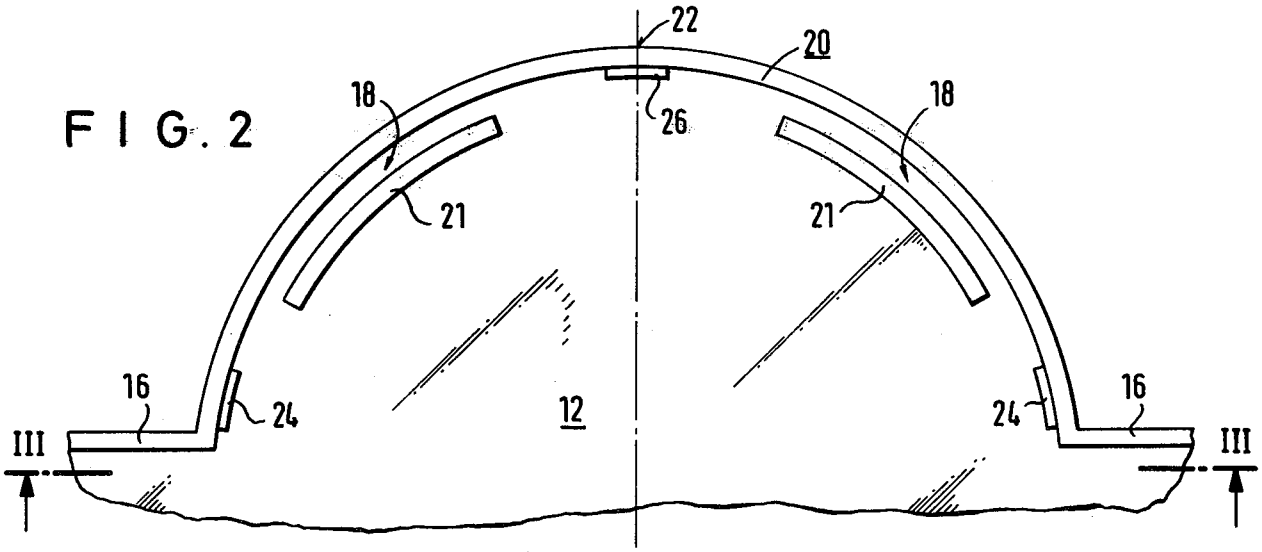
FIG. 2 represents a top view onto a part of a story deck in the area of a receiving shaft.

In FIG. 2 one recognizes a receiving shaft 18 at a story deck 12. This receiving shaft 18 is defined by an outer shaft-limiting wall 20 forming a part of the encircling wall 16. Further constituents in the construction of the receiving shaft 18 are inner shaft-limiting walls 21. These inner shaft-limiting walls 21 face the outer shaft-limiting wall 20 at an approximately constant distance corresponding to the wall thickness of the spacing supports 14 and are located on both sides of the crest 22 of the outer shaft-limiting wall 20 at the same distance from this crest 22. The inner shaft-limiting walls 21 do not reach to the ends of the outer shaft-limiting wall 20 with its ends spaced from one another. At the outer shaft-limiting wall 20 there are affixed cams 24 and 26, namely on the concave side.

Figure 4:
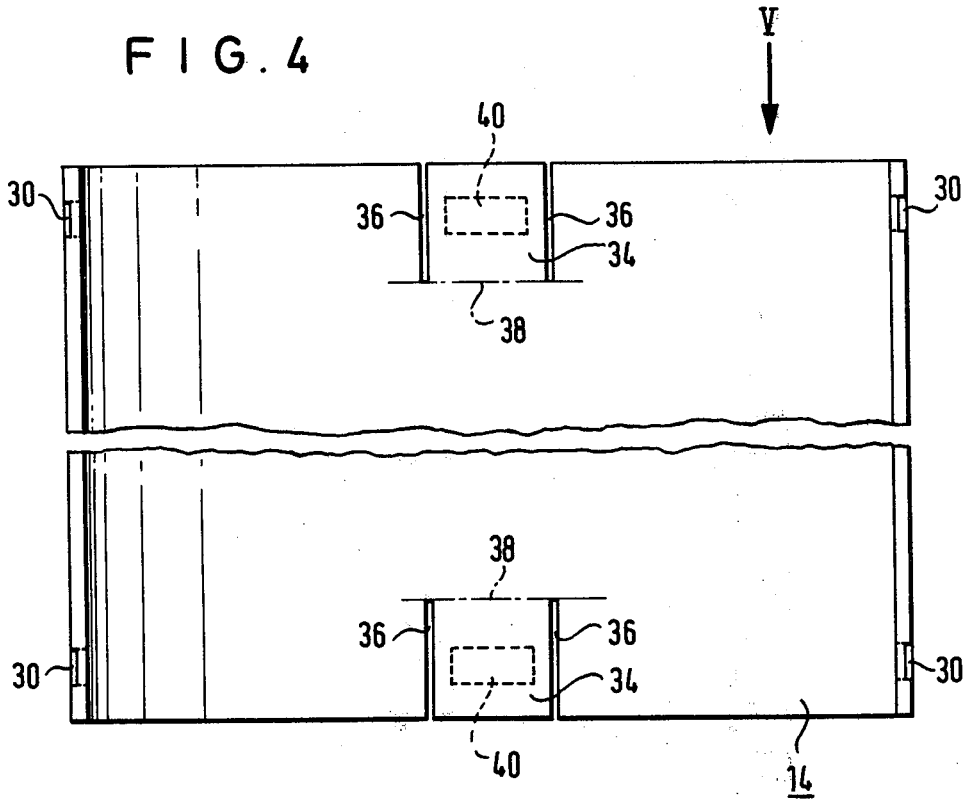
FIG. 4 represents a view onto the concave side of a spacing support according to the invention.
Figure 5:
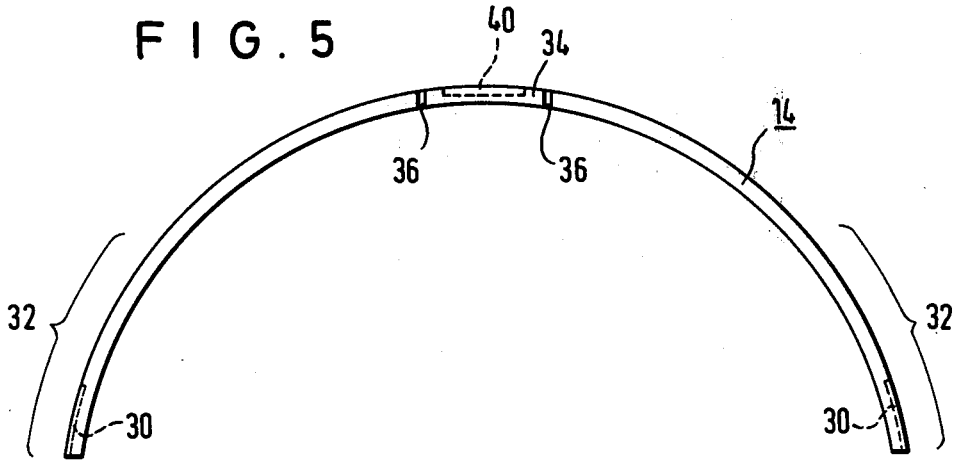
FIG. 5 represents an end view of a spacing support in the direction of the arrow V of FIG. 4.

FIGS. 4 and 5 show a groove-shaped spacing support 14 extending over the same arc angles as the outer shaft-limiting wall 20, said spacing support being destined to be stuck into the receiving shaft 18. At the spacing support 14 there are made depressions 30 near its vertical longitudinal edges, said depressions being intended for receiving the cams 24 when an end of the spacing support 14 is pushed into a receiving shaft 18. Thereat the edge areas 32 of the spacing support 14 are propped resiliently against the outer shaft-limiting wall 20 until the pins 24 can catch in the depressions 30, whereupon the edge areas 32 spring back again so as to rest against the outer shaft-limiting wall 20. In its crest area the spacing support 14 has, at its upper and lower end, respectively one spring 34. The springs 34 are formed by slots 36 in such a way that the springs 34 can be tilted elastically around the axes 38. At the springs 34 there are made depressions 40 which can receive the cams 26 of the outer shaft-limiting wall 20 when a spacing support 14 is pushed into the receiving shaft 18 with one of its ends. Thereat the springs 34 veer away from the arc wall 20 inwards until such time as the cam 26 catches in the corresponding depression 40. The spring 34 can then return to rest against the outer shaft-limiting wall 20. The slots 36 can be higher than the encircling wall 16 in such a way as to facilitate the detachment of the spacing supports 14. If this dimensioning prescription is not observed, however, one can grasp behind the spring 34 with a blade to detach them and then deflect them outward.

Figure 3:
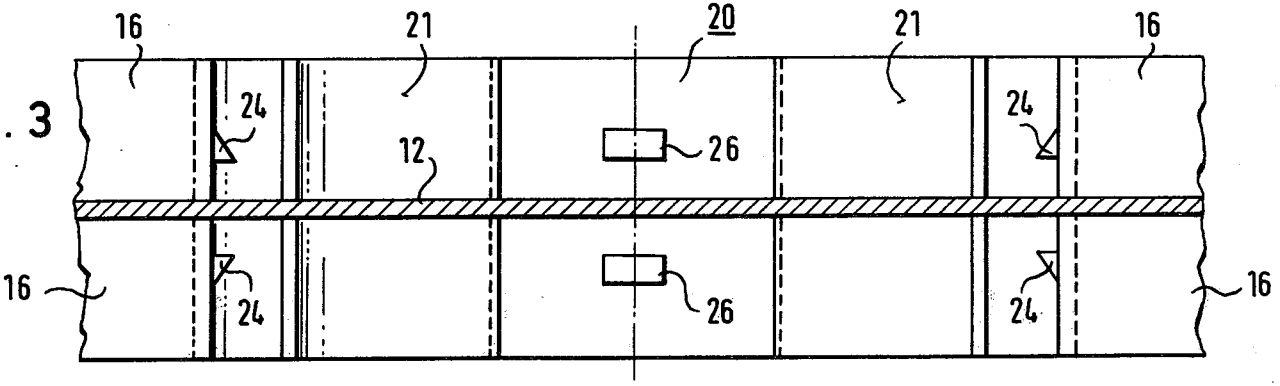
FIG. 3 represents a section according to line III—III of FIG. 2.

FIG. 3 reveals the construction of the cams, which construction permits the spacing supports to be easily pushed into the shaft until the cams 24 rest in the depressions 30. The same applies to the construction of the cams 26.

When the cams 24 and 26 rest in the depressions 30 and 40, the respective spacing support 14 stands with its respective end ridge on the respective story deck 12, essentially without wobbling.

The story decks 12 with the encircling wall 16 and with the inner shaft-limiting walls 21 as well as the securing cams 24 and 26 can be formed as single-piece injection molded parts, the inner shaft-limiting wall 21 being connected only with the story decks 12 and freely cantilevering therefrom. Similarly, the spacing supports 14 can be fabricated as single-piece injection mold parts together with the depressions 30 and 40 and the slots 36.

The story decks as well as the spacing supports can be made of transparent material, for instance, transparent plastic in order to improve even further the view onto the goods laid out on the story deck 12.

Divergences from the so far described embodiments are of course possible; it is thus conceivable that the cams 24 and 26 be affixed to the spacing supports 14 and the depressions, on the other hand, at the outer shaft-limiting wall 20.

I claim:

1. A multiple-story tower for the display of merchandise comprising:

A. a plurality of spaced story decks each encircled by an encircling wall extending around the edge of said story deck and each said story deck having a center spaced equidistantly from the opposite sides thereof, B. two spacing supports extending between and connecting two adjacent said story decks, C. each said story deck having a first axis and a second axis extending perpendicularly to one another and intersecting at said center and said story decks arranged symmetrically about each of said axes, D. each spacing support located at an opposite end of the first axis where the first axis intersects said encircling wall, E. each said spacing support, forming a groove-like configuration and having an outer surface facing away from said center and an inner surface facing toward said center, F. said spacing supports between adjacent said spaced story decks having an approximately constant cross-section in a sectional plane parallel with said story decks, G. said story decks include receiving shafts at the location of the intersection of the first axis with the encircling wall, said receiving shafts arranged to receive and align said spacing supports, H. each said receiving shaft is formed by at least one outer shaft-limiting wall forming a part of said encircling wall and located at the intersection of the first axis with said encircling wall and at least one inner shaft-limiting wall located closer to the center of said story deck, said outer shaft-limiting wall is shaped complementary to the outer surface of said spacing support and said inner shaft limiting wall is shaped complementary to the inner surface of said spacing support, I. snap securing means for securing said spacing support to at least one of said inner and outer shaft-limiting walls, J. said securing means includes a cam and a depression arranged to receive said cam, K. each said cam has a surface extending obliquely to the surfaces of said spacing support and the respective inner and outer limiting wall, L. said story decks are closed in the area of said receiving shafts, and M. the length of said spacing supports in the direction of the second axis is significantly less than the length of the second axis between its intersection with said encircling wall along the edges of said story decks.

2. A multiple-story tower for the display of merchandise comprising:

A. A plurality of spaced story decks each encircled by an encircling wall extending around the edge of said story deck and each said story deck having a center spaced substantially equidistantly from the opposite sides thereof, B. a plurality of spacing supports extending between and connecting two adjacent said story decks, C. said spacing supports each having an open groove-like configuration and each having an inner surface facing the center of said story deck and an outer surface facing away from the center of said story deck, D. each said story deck having a plurality of pairs of receiving shafts for receiving and aligning said spacing supports, E. each said receiving shaft is formed by at least one outer shaft-limiting wall forming a part of said encircling wall and at least two inner shaft-limiting walls located closer to the center of said story deck, said first shaft-limiting wall is shaped complementary to the outer surface of said spacing support and said second shaft-limiting wall is shaped complementary to the inner surface of said support, F. said first shaft-limiting wall having a crest and said second shaft-limiting walls are spaced from said crest, G. each said spacing support has a spring-like section formed between spaced slots in said spacing support and said spring-like section located between said inner shaft-limiting walls, H. first snap-securing means are provided between said spring-like section and said outer shaft-limiting wall, the ends of said spacing supports on the opposite sides of said crest extend beyond said inner shaft-limiting walls along said outer shaft-limiting walls, and I. second snap-securing means being located between said spacing supports and said outer shaft-limiting wall in the region beyond said inner shaft-limiting walls.

3. A multiple-story tower, as set forth in claim 1 or 2, wherein said inner surfaces of said spacing supports are concavely shaped.

4. A multiple-story tower, as set forth in claim 1 or 2, wherein each of said story decks has a substantially rectangular outline defined by said encircling wall.

5. A multiple-story tower, as set forth in claim 1 or 2, wherein the first axis of said story decks is longer than the second axis thereof.

6. A multiple-story tower, as set forth in claim 1 or 2, wherein said groove configuration of said spacing supports has a cross-sectional shape in the form of a partial circle.

7. A multiple-story tower, as set forth in claim 6, wherein said groove configuration of said spacing supports is in the form of a semi-circle.

* * * * *